US011326566B2

(12) United States Patent
Roth

(10) Patent No.: US 11,326,566 B2
(45) Date of Patent: May 10, 2022

(54) TRANSPORT VALVE SYSTEM FOR OUTDOOR POWER EQUIPMENT

(71) Applicant: Briggs & Stratton, LLC, Wauwatosa, WI (US)

(72) Inventor: David Roth, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 429 days.

(21) Appl. No.: 15/909,032

(22) Filed: Mar. 1, 2018

(65) Prior Publication Data

US 2018/0252190 A1 Sep. 6, 2018

Related U.S. Application Data

(60) Provisional application No. 62/466,257, filed on Mar. 2, 2017.

(51) Int. Cl.

| | |
|---|---|
| ***F02M 37/00*** | (2006.01) |
| ***F02D 31/00*** | (2006.01) |
| ***F02D 41/06*** | (2006.01) |
| *F02P 15/00* | (2006.01) |
| *F02B 63/00* | (2006.01) |
| *F02B 61/00* | (2006.01) |

(52) U.S. Cl.

CPC ..... *F02M 37/007* (2013.01); *F02D 31/002* (2013.01); *F02D 31/007* (2013.01); *F02D 41/067* (2013.01); *F02B 61/00* (2013.01); *F02B 63/00* (2013.01); *F02P 15/006* (2013.01)

(58) Field of Classification Search

CPC ..... F02D 9/10; F02D 9/107; F02D 9/1065; F02D 9/02

USPC ..... 123/336–339.1, 339.25, 339.28

See application file for complete search history.

(56) References Cited

U.S. PATENT DOCUMENTS

| | | | | |
|---|---|---|---|---|
| 2,323,222 A * | 6/1943 | Holley | ..... | F02M 1/04 261/23.2 |
| 3,577,806 A * | 5/1971 | Schaefer | ..... | F16H 59/24 477/156 |
| 3,844,311 A * | 10/1974 | McSwain | ..... | F16K 21/06 137/624.11 |

(Continued)

FOREIGN PATENT DOCUMENTS

| | | |
|---|---|---|
| DE | 674170 C | 4/1939 |
| JP | H1182885 A | 3/1999 |

*Primary Examiner* — John Kwon

*Assistant Examiner* — Johnny H Hoang

(74) *Attorney, Agent, or Firm* — Foley & Lardner LLP

(57) ABSTRACT

An engine including a fuel tank, a carburetor, a speed control lever, and a transport valve. The carburetor includes a throttle valve movable between a first throttle position and a second throttle position. The speed control lever is coupled to the throttle valve and is movable between a first position corresponding to the first throttle position and a second position corresponding to the second throttle position. The transport valve is fluidly coupled between the fuel tank and the carburetor, and includes a valve element moveable between an open valve position allowing fuel flow between the fuel tank and the carburetor, and a closed valve position preventing fuel flow between the fuel tank and the carburetor. Movement of the speed control lever to the second position moves the valve element to the closed valve position to stop fluid flow between the fuel tank and the carburetor.

15 Claims, 14 Drawing Sheets

(56) References Cited

U.S. PATENT DOCUMENTS 4,172,864 A * 10/1979 Hohsho ..... F02M 1/04 123/179.15
4,283,040 A * 8/1981 Kolze ..... F16K 31/404 251/30.03
5,720,250 A 2/1998 Greppmair et al.
5,819,711 A * 10/1998 Motose ..... F02B 61/045 123/516
6,082,323 A 7/2000 Winberg
6,357,415 B1 3/2002 Mori
6,561,211 B2 * 5/2003 Devall ..... B60K 15/03504 137/202
6,615,792 B1 9/2003 Grifka et al.
6,640,770 B2 11/2003 Woody
6,857,410 B2 2/2005 Davis et al.
7,231,900 B1 6/2007 Hanshaw
7,938,138 B2 * 5/2011 Chaffee ..... F16K 15/202 137/223
8,408,183 B2 * 4/2013 Johnson ..... F02D 11/02 123/198 D
8,776,823 B2 7/2014 Suehiro
9,074,535 B1 7/2015 Huibregtse et al.
9,243,578 B2 1/2016 Cleeves et al.
9,261,030 B2 2/2016 Mitchell et al.
9,476,370 B2 10/2016 Repasky et al.
2001/0008132 A1 7/2001 Ikeda
2005/0257836 A1 * 11/2005 Boyer ..... G05D 16/0666 137/505.34
2007/0251586 A1 * 11/2007 Fuller ..... F04B 27/1804 137/596.16
2008/0302332 A1 12/2008 Dow et al.
2010/0059123 A1 * 3/2010 Martin ..... F02M 37/0076 137/14
2012/0318885 A1 * 12/2012 Grandi ..... F02M 51/0664 239/5
2013/0112767 A1 * 5/2013 Mahmood ..... F02M 47/027 239/11
2016/0131047 A1 5/2016 Mitchell et al.
2018/0252190 A1 * 9/2018 Roth ..... F02M 37/007

* cited by examiner

TRANSPORT VALVE SYSTEM FOR OUTDOOR POWER EQUIPMENT

CROSS REFERENCE TO RELATED APPLICATION

This application claims the benefit of U.S. Provisional Patent Application No. 62/466,257 filed on Mar. 2, 2017, the entirety of which is incorporated by reference.

BACKGROUND

The present invention relates generally to the field of fuel delivery systems. More specifically, the present invention relates to fuel delivery systems for engines configured to run outdoor power equipment.

Outdoor power equipment is typically driven by an internal combustion engine. The engine includes a carburetor, which adds fuel to air flowing through the engine for combustion processes occurring within the engine. During transport or during extended storage periods of the outdoor power equipment, it is desirable to inhibit fuel flow to the carburetor. Typically, a valve or stop cock is positioned in the fuel line to selectively provide and inhibit fuel flow to the carburetor.

SUMMARY

One embodiment relates to an engine that includes a fuel tank, a carburetor, a speed control lever, and a transport valve. The carburetor includes a throttle valve movable between a first throttle position and a second throttle position. The speed control lever is coupled to the throttle valve and is movable between a first position corresponding to the first throttle position and a second position corresponding to the second throttle position. The transport valve is fluidly coupled between the fuel tank and the carburetor, and includes a valve element moveable between an open valve position allowing fuel flow between the fuel tank and the carburetor, and a closed valve position preventing fuel flow between the fuel tank and the carburetor. Movement of the speed control lever to the second position moves the valve element to the closed valve position to stop fluid flow between the fuel tank and the carburetor.

Another embodiment relates to an engine shutoff system for an engine having a carburetor. The engine shutoff system includes a speed control lever, and a valve moveable in response to movement of the speed control lever between an open position allowing fuel flow to the carburetor and a closed position inhibiting fuel flow to the carburetor.

Another embodiment relates to a method of inhibiting fuel flow to a carburetor. The method includes moving a speed control lever from an on position to an off position, and moving a valve closure element from an open position where fuel flow is permitted, to a closed position where fuel flow is inhibited in response to movement of the speed control lever to the off position.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the drawings, a transport valve system for an engine is shown and described that includes a speed control system including a valve that is responsive to a speed control lever or another speed control component such as a governor system component. The speed control component may be located remotely from the engine, or may be electronically controlled, for example by a controller. The speed control component is arranged to affect the operational speed of the engine, and is movable between an off position in which the engine cannot run and a range of on positions in which the engine is able to run. The operational speed of the engine is controlled, at least in part, by the position of the speed control component within the range of on positions and the speed control component may be manipulated to adjust the operational speed of the engine. When the speed control component is in the off position, the valve is moved to a closed position and fuel flow to the carburetor is cut off. In some embodiments, the transport valve system also includes an electrical shutoff switch that is also responsive to the speed control component. When the speed control component is in the off position, the electrical shutoff switch is actuated and an electrical system of the engine is stopped from operating. In this way, moving the speed control component to the off position cuts off fuel flow and kills the electrical system of the engine without the need for a separately actuated stopcock (or fuel shutoff valve) and electrical system on-off switch.

Figure 1:
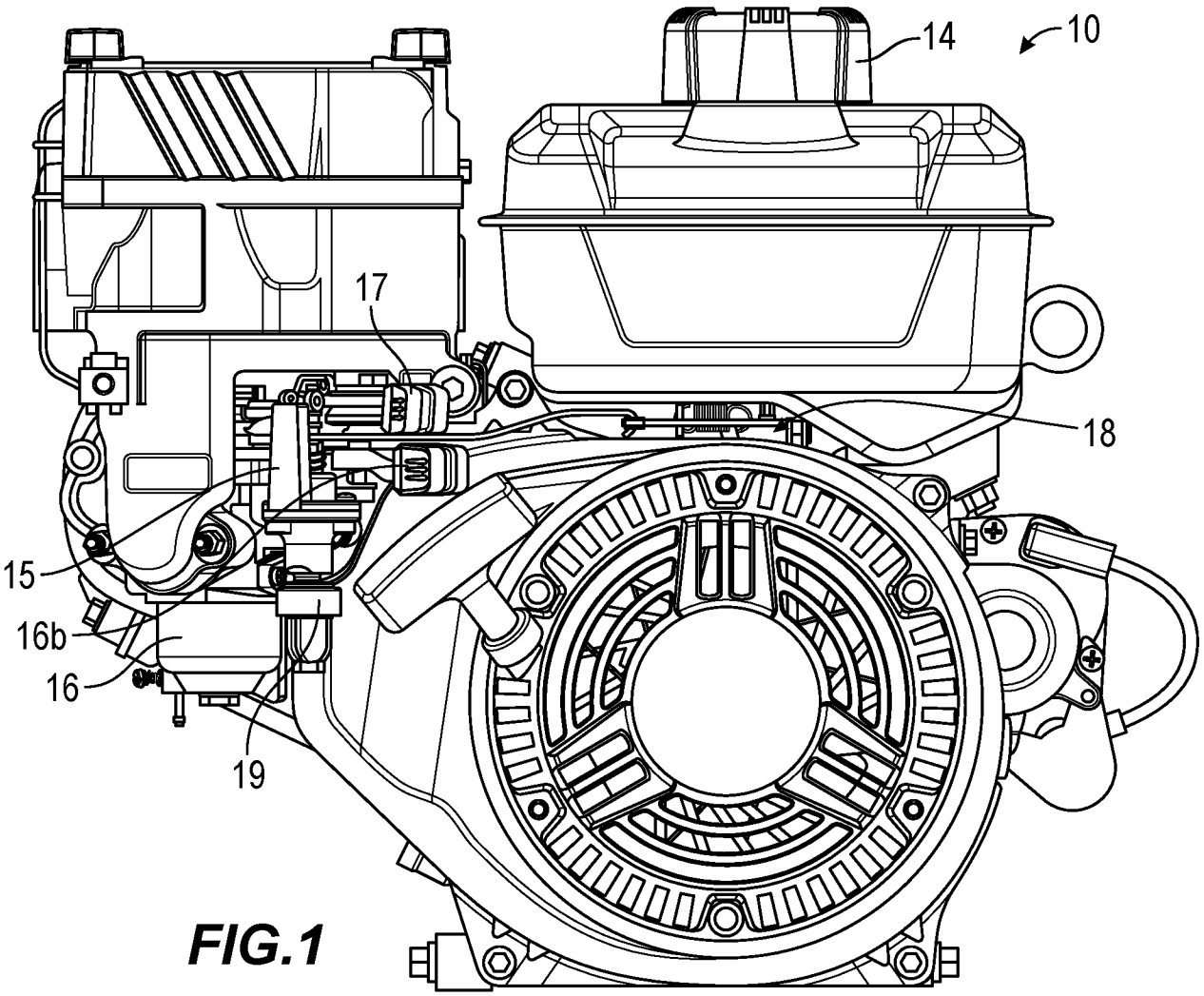
FIG. 1 is a front view of an engine including a transport valve system according to one embodiment.
Figure 2:
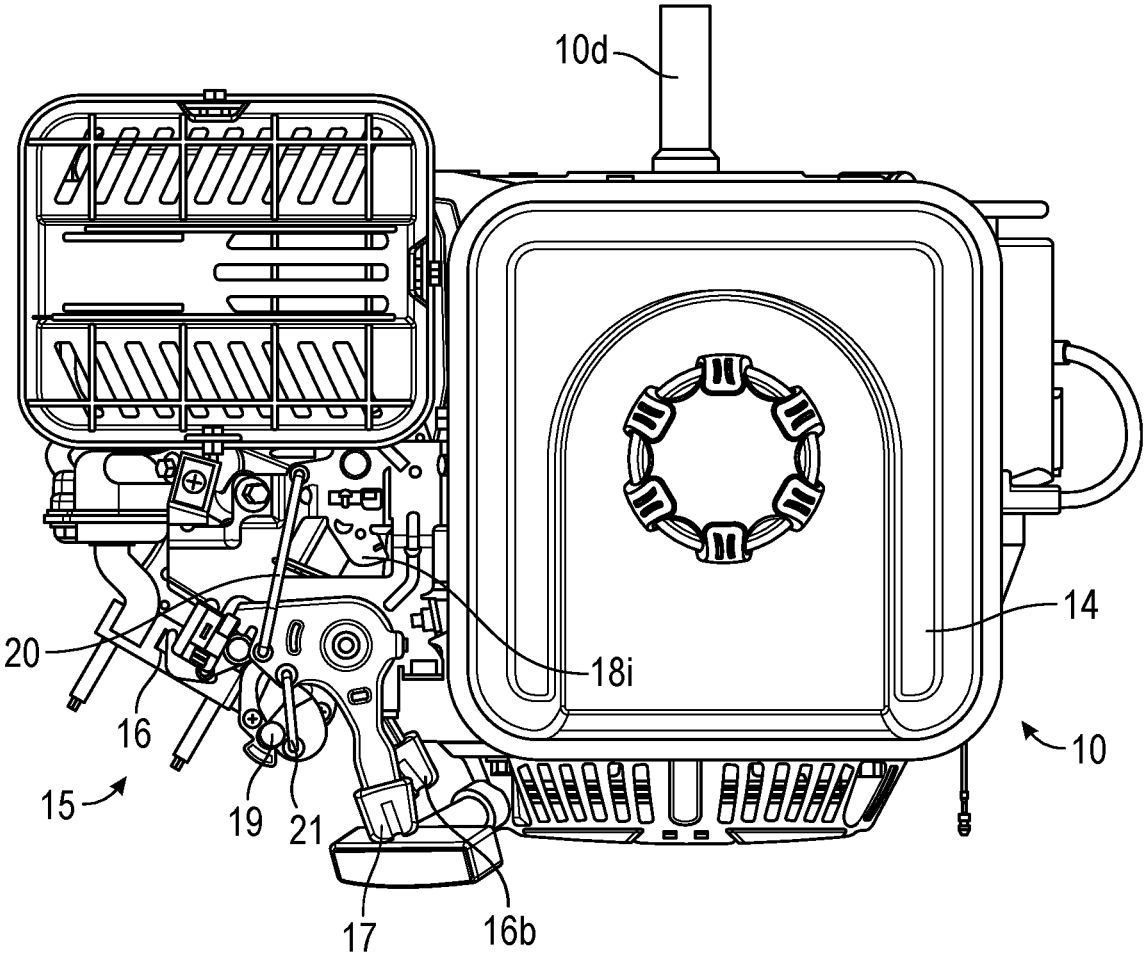
FIG. 2 is a top view of the engine of FIG. 1.

As shown in FIGS. 1 and 2, an engine 10 includes, a fuel tank 14, and a speed control system 15 that includes a carburetor 16, a speed control lever 17, a governor system 18, and a transport valve system 19. The engine 10 may be used to power outdoor power equipment, portable jobsite equipment, or other equipment that requires a prime mover. Outdoor power equipment may include lawn mowers, riding tractors, snow throwers, pressure washers, tillers, log splitters, zero-turn radius mowers, walk-behind mowers, riding mowers, stand-on mowers, pavement surface preparation devices, industrial vehicles such as forklifts, utility vehicles, commercial turf equipment such as blowers, vacuums, debris loaders, overseeders, power rakes, aerators, sod cutters, brush mowers, portable generators, etc. Outdoor power equipment may, for example, use the engine 10 to drive an implement, such as a rotary blade of a lawn mower, a pump of a pressure washer, an auger of a snow thrower, and/or a drivetrain of the outdoor power equipment. Portable jobsite equipment may include portable light towers, mobile industrial heaters, and portable light stands.

The carburetor 16 includes a throttle valve 16*a* (see FIG. 8) that is moveable between a first position in the form of a low speed position and a second position in the form of a high speed position and thereby control the air fuel mixture exiting the carburetor 16 and entering the combustion chamber of the engine 10, and a choke lever 16*b* arranged to adjust the position of a choke valve to control air flow into the carburetor 16. The carburetor 16 is arranged to mix fuel from the fuel tank 14 with air and provide the mixture to a combustion cylinder.

Figure 6:
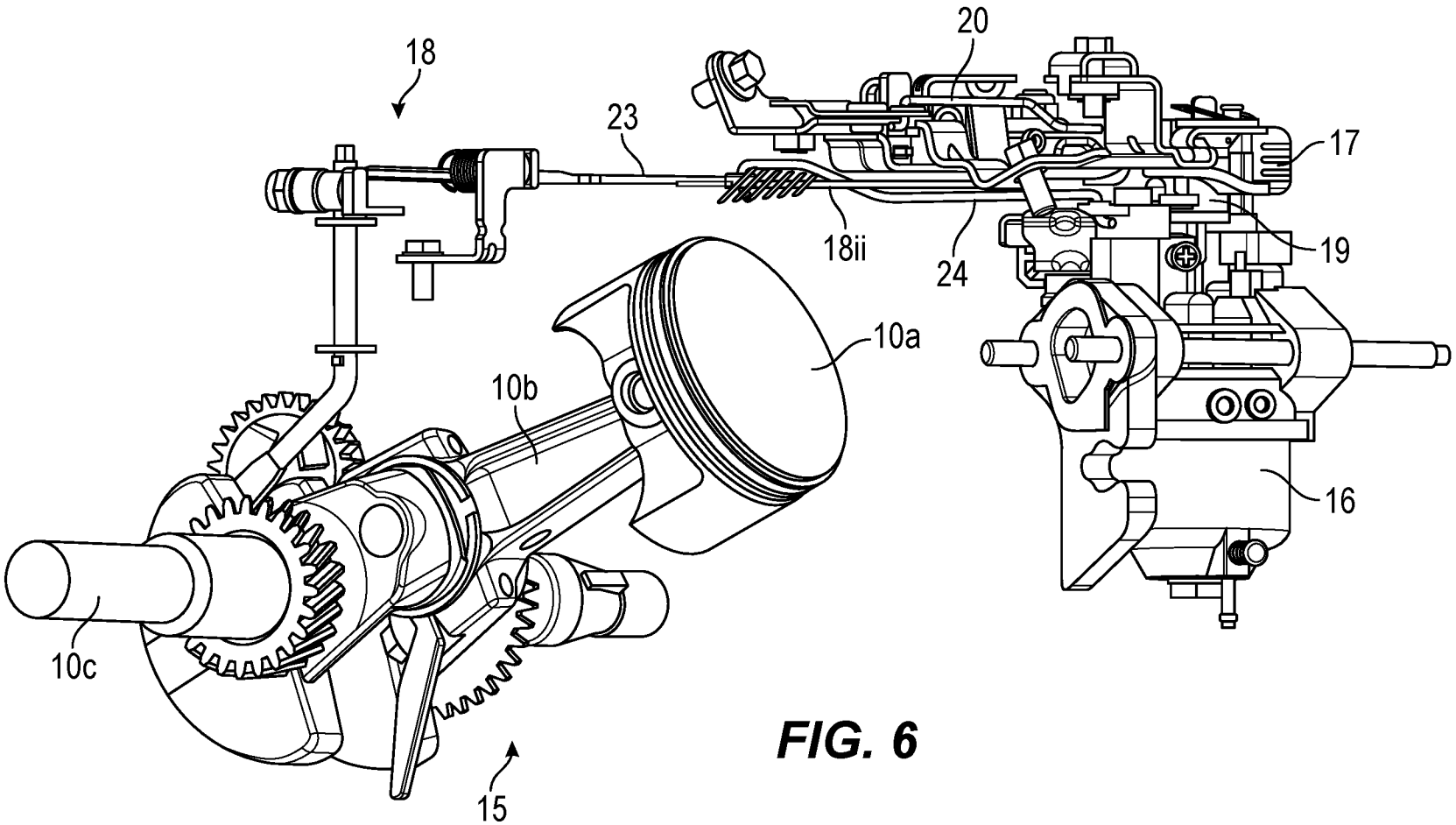
FIG. 6 is a back, left perspective view of the speed control system of FIG. 3.

The engine 10 may be in the form of a small, single-cylinder, four-stroke cycle, internal combustion engine and includes an engine block, an air intake, and an exhaust. Interior to the engine 10, the engine 10 includes a passageway configured to channel air from the air intake to a combustion chamber. Along the passageway, fuel is mixed with the air in the carburetor 16 or other fuel injection device. With reference to FIG. 6, combustion in the combustion chamber converts chemical energy to mechanical energy (e.g., rotational motion; torque) via a piston 10*a*, a connecting rod 10*b*, and a crankshaft 10*c*, which may then be coupled to one or more rotating tools (e.g., blade, alternator, auger, impeller, tines, drivetrain, etc.) of outdoor power equipment. In the illustrated embodiment, the crankshaft 10*c* is a horizontal crankshaft arranged to provide power to an output shaft 10*d* arranged to provide power to one or more implements. In other embodiments, the crankshaft 10*c* is a vertical crankshaft. In other embodiments, the engine 10 includes two or more cylinders (e.g., two cylinders arranged in a V-twin configuration).

The speed control lever 17 is coupled to the carburetor 16 via the governor system 18, and the speed control lever 17 and the governor system 18 cooperate to control the amount of fuel air mixture provided to the combustion chamber of the cylinder and thereby vary the operating speed of the engine 10. The transport valve system 19 is arranged in the fuel flow path between the fuel tank 14 and the carburetor 16 and operates in response to the speed control lever 17 to selectively inhibit fuel flow from the fuel tank 14 to the carburetor 16.

Figure 3:
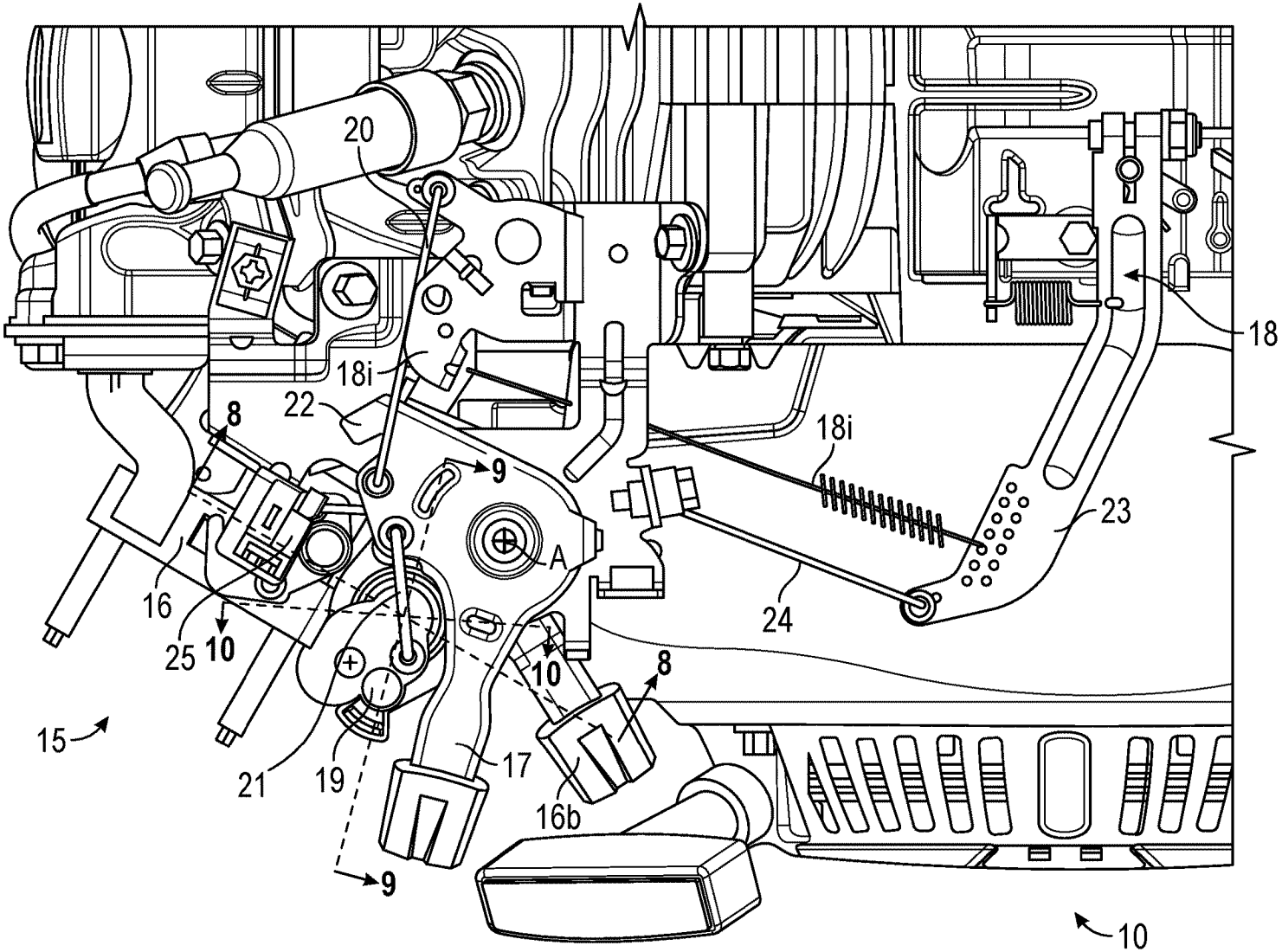
FIG. 3 is a detail view showing a speed control system of the engine of FIG. 1.

As shown in FIG. 3, the speed control lever 17 includes a speed control linkage in the form of a speed control rod 20 that is coupled to the governor system 18, and fuel control linkage in the form of a fuel control rod 21 that is coupled to the transport valve system 19. The speed control lever 17 is actuatable about a speed control axis A between an off position (see FIG. 2), and a range of on positions (an exemplary on position is shown in FIG. 3). The range of on positions vary the fuel air mixture flow from the carburetor and thereby vary the speed of the engine 10. The speed control lever 17 further includes a shutoff element in the form of a shutoff cam surface 22. The shutoff cam surface 22 defines a ramped profile.

The governor system 18 is coupled between the speed control lever 17 and the carburetor 16 and governs the speed of the engine 10. The governor system 18 includes a speed control bellcrank 18*i* movable in response to the speed control rod 20, a governor arm 23 coupled to the governor plate by a governor spring 18*ii* and controlled by a governor or speed sensing device in response to the speed of the engine 10, and a governor rod 24 that is coupled to the throttle valve 16*a* to control the fuel air mixture provided to the combustion chamber of the engine 10. In some embodiments, moving the speed control lever 17 changes the tension in the governor spring 18*ii* which affects the speed of the engine 10 by changing the force balance in governor system 18, which moves the throttle valve 16*a* via the governor arm 23 and governor rod 24. In some embodiments, this only affects the position of the throttle valve 16*a* if the engine 10 is running. When the engine 10 is off, moving the speed control lever 17 has no effect on the position of the throttle valve 16*a* as the throttle valve 16*a* is held in the fully open state by a governor idle spring. The governor system 18 may also include weights, a slider cup, a crank, springs, links, and other components, as desired.

Figure 4:
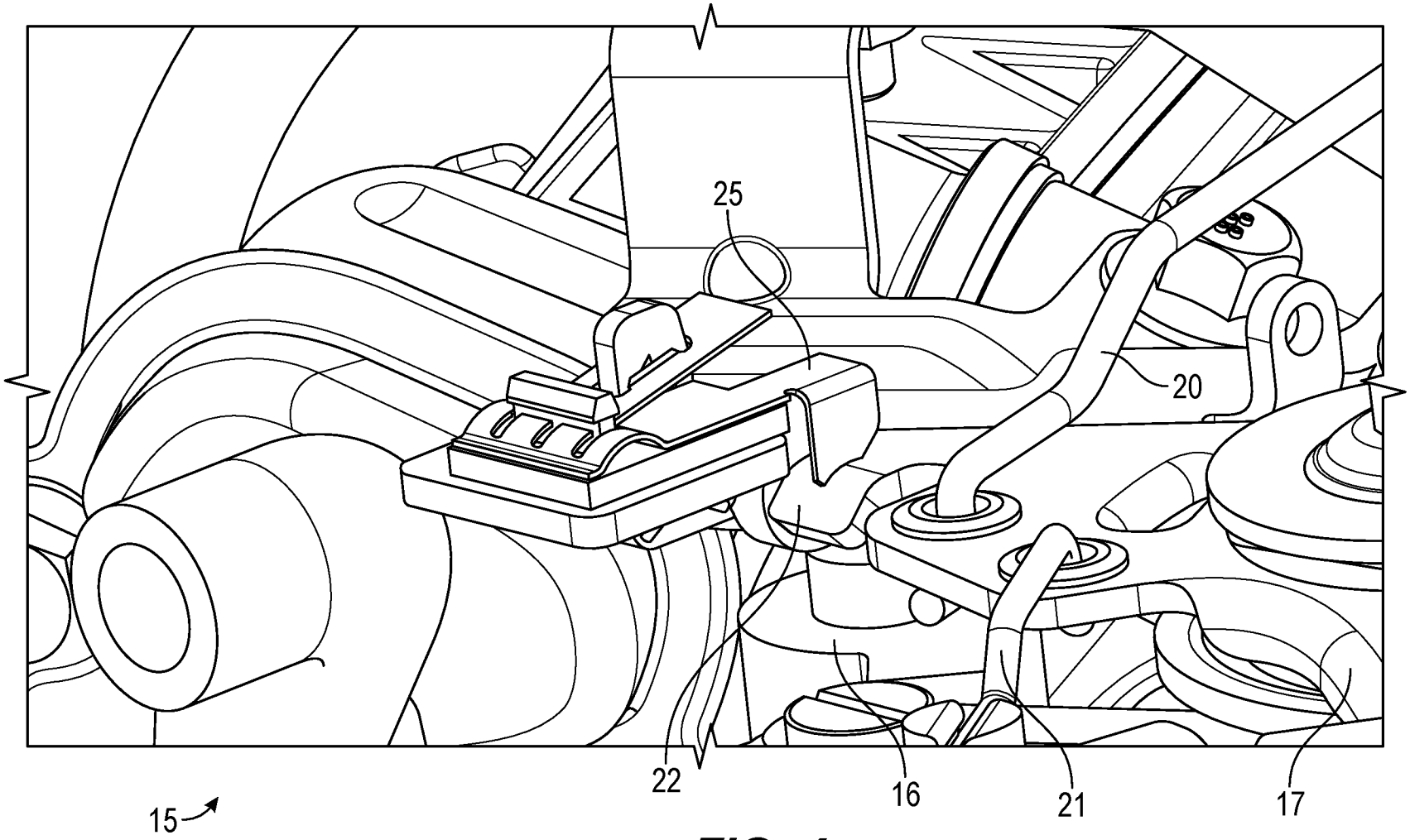
FIG. 4 is a detail perspective view of the speed control system of FIG. 3 showing an electrical shutoff switch.

As shown in FIG. 4, the speed control system 15 also includes an electrical shutoff switch 25 (e.g., a kill switch) arranged to interact with the shutoff cam surface 22 of the speed control lever 17. The electrical shutoff switch 25 is arranged to selectively discontinue electrical power to the engine 10. In one embodiment, the electrical shutoff switch 25 selectively discontinues power to the engine 10 by grounding an ignition coil. In the illustrated embodiment, the electrical shutoff switch 25 is a blade stopswitch, though in other embodiments a microswitch such as a normally on or normally off switch, or another type of switch may be used. The electrical shutoff switch 25 is movable between an ungrounded (i.e., on) state when the speed control lever is in the on position and a grounded (i.e., off) state when the control lever is in the off position.

Figure 5:
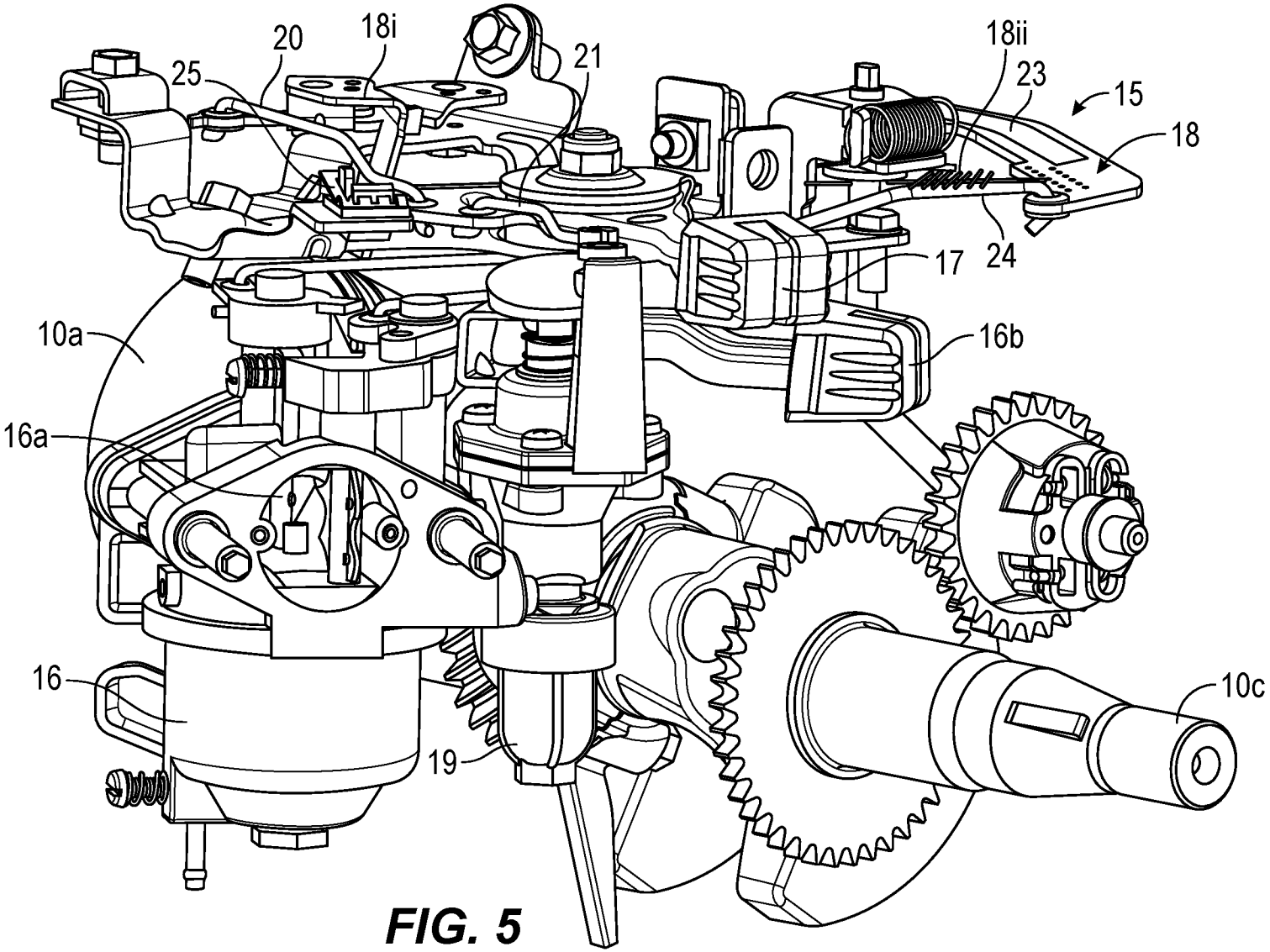
FIG. 5 is a front, right perspective view of the speed control system of FIG. 3.

As shown in FIGS. 5-6 and discussed above with respect to the governor system 18, the speed control lever 17 is moveable to affect the position of the throttle valve 16*a* of the carburetor 16 and to control the transport guard system 19.

Figure 7:
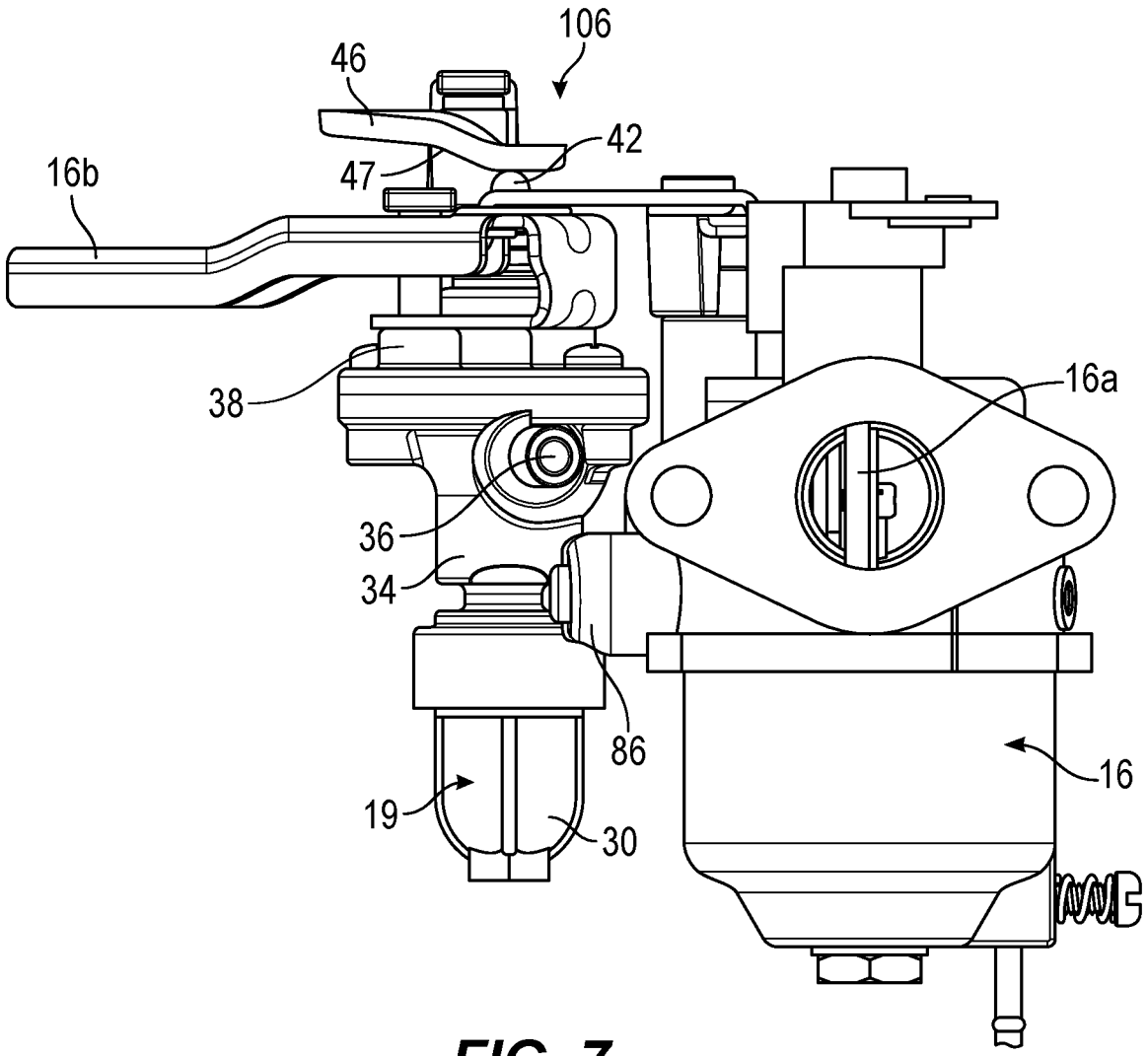
FIG. 7 is a right side view of a transport guard valve and a carburetor of the speed control system of FIG. 3.

As shown in FIG. 7, the transport valve system 19 includes a fuel bowl 30, a valve housing 34, a fuel inlet barb 36, a bonnet 38, a cam follower 42, and a cam 46. Generally, fuel enters the fuel inlet barb 36 from the fuel tank 14, and passes through the valve housing 34 and the fuel bowl 30 before entering the carburetor 16. The cam 46 is coupled to the speed control lever 17 by the fuel control rod 21 and the cam follower 42 moves in response to the change in position of the cam 46 due to movement of the speed control lever 17. In one embodiment, the cam 46 is arranged to rotate in response to movement of the speed control lever 17 and defines a cam profile 47 that interacts with the cam follower 42 in order to actuate the transport valve system 19.

Figure 8:
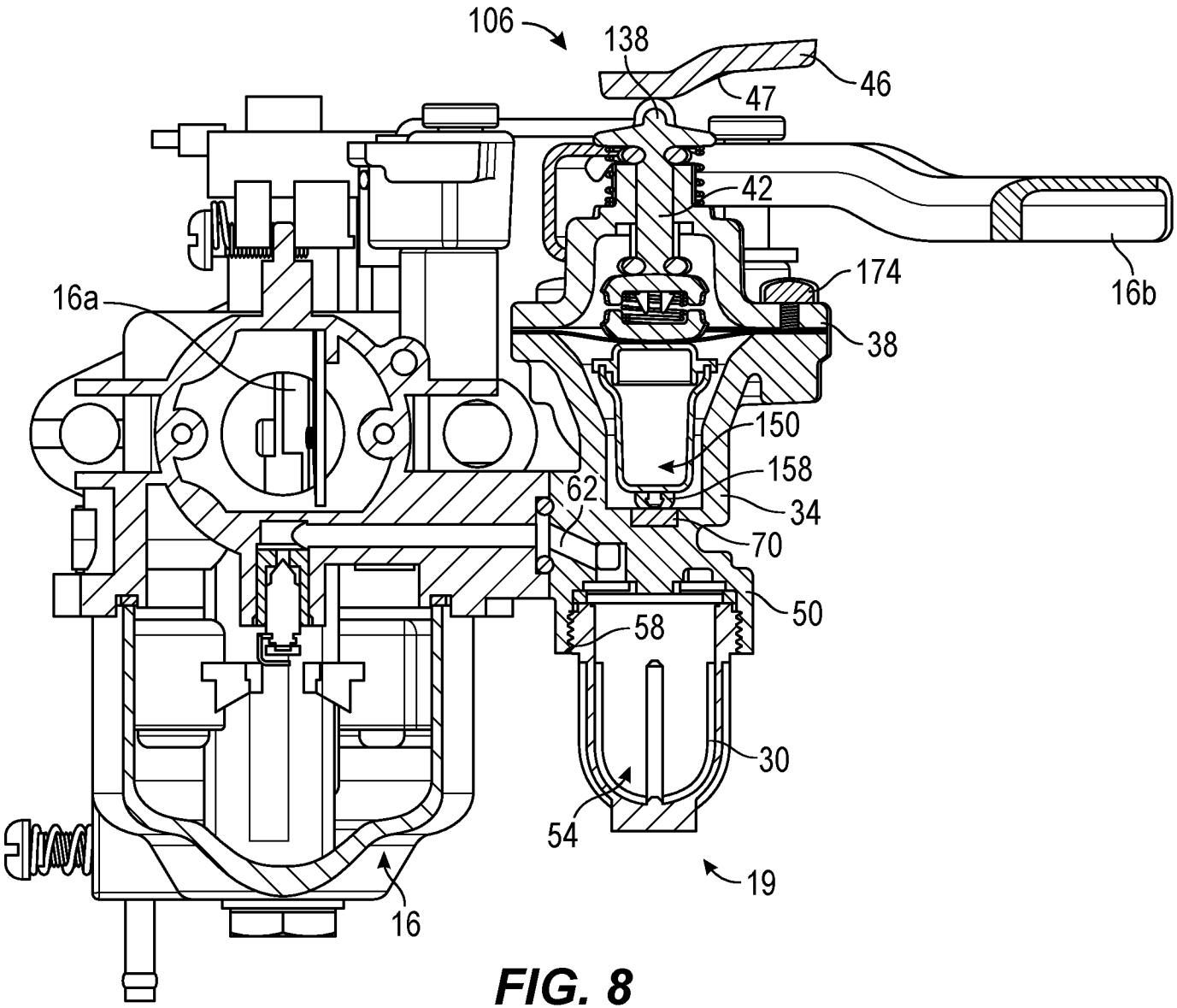
FIG. 8 is a section view of the transport guard valve and the carburetor taken along line 8-8 of FIG. 3.

As shown in FIG. 8, the fuel bowl 30 includes a coupling feature in the form of threads 50 and defines a fuel cavity 54 that is arranged to hold fuel.

The valve housing 34 includes a coupling feature in the form of threads 58 sized to threadingly engage the threads 50 of the fuel bowl 30. A fuel outlet 62 is formed in the valve housing 34 and is arranged to provide fuel to the carburetor 16. In other embodiments, the fuel outlet 62 may be formed in the fuel bowl 30.

Figure 9:
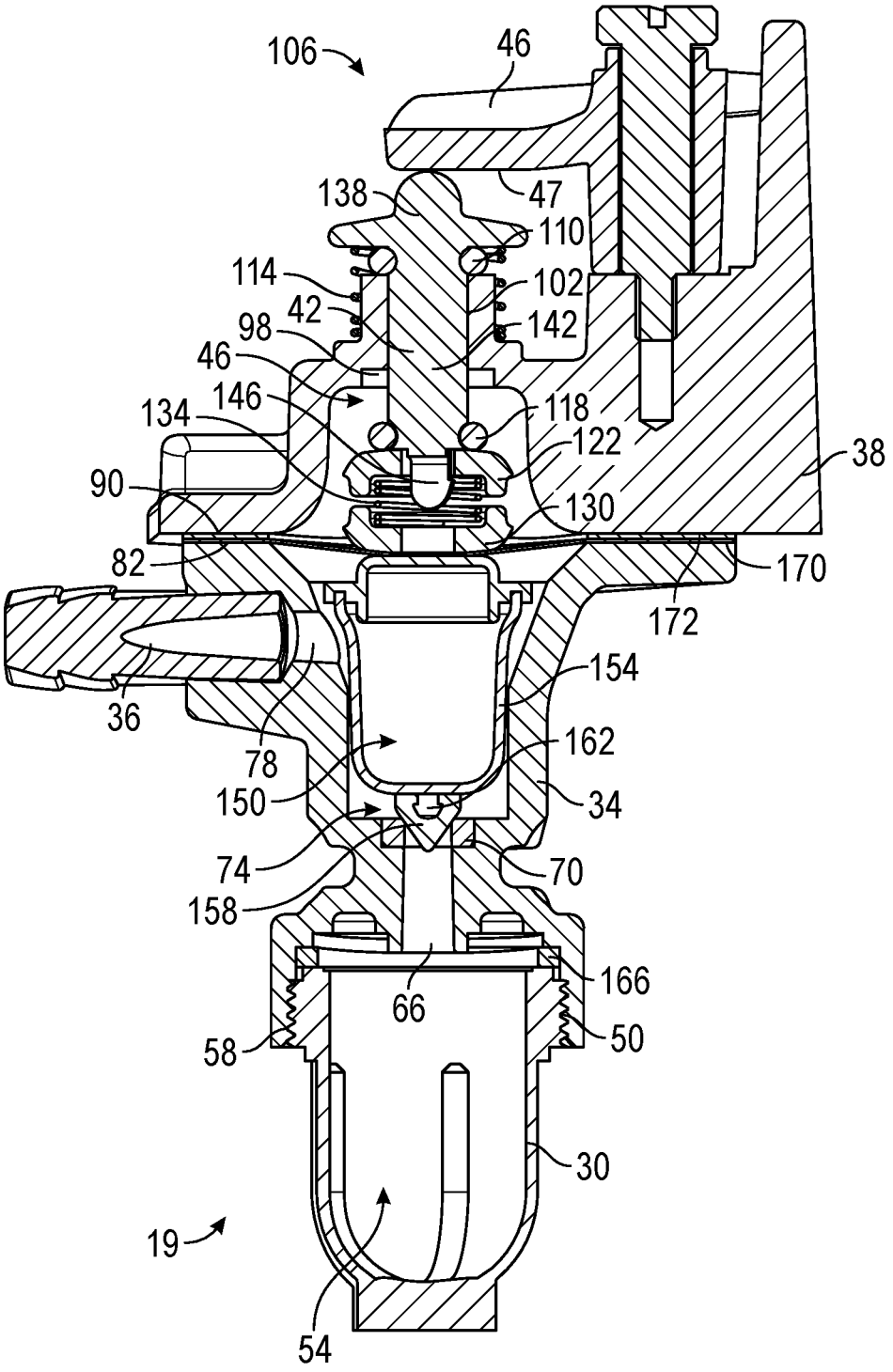
FIG. 9 is a section view of the transport guard valve taken along line 9-9 of FIG. 3.

As shown in FIG. 9, a fuel passage 66 formed in the valve housing 34 provides a flow path to the fuel cavity 54 from a valve seat 70. The illustrated valve seat 70 is a separate element that is received in the valve housing 34, but in other embodiments, the valve seat 70 may be formed as a part of the valve housing 34 or may be coupled to the valve housing 34 in another way. A valve cavity 74 is defined upstream of the valve seat 70 and a housing fuel inlet 78 provides a flowpath for fuel to enter the valve cavity 74 from the fuel inlet barb 36. The valve housing 34 also includes a housing flange 82 and a mounting flange 86 (see FIG. 7). The fuel inlet barb 36 is press fit into the housing fuel inlet 78 and arranged to receive a fuel line that connects to the fuel tank 14.

The bonnet 38 includes a bonnet flange 90 sized to mate with the housing flange 82, a bonnet cavity 94, a seal recess 98, and an actuator aperture 102. The bonnet 38 is structured to receive an actuation assembly 106 that includes the cam follower 42, an external seal 110, an external spring 114, an internal seal 118, a first button 122, a second button 130, and an internal spring 134. The cam follower 42 includes a follower cap 138, a follower shaft 142 that is sized to fit within the actuator aperture 102, and a projection 146 sized to engage the first button 122.

A valve closure assembly 150 is positioned in the valve cavity 74 and includes a float 154 and a valve element 158 structured to engage the valve seat 70. The float 154 is structured so that a floatation bias is provided when fuel is present in the valve cavity 74. In other words, when fuel is present in the valve cavity 74, the float 154 rises (as shown in FIG. 9) and the valve element 158 is disengaged from the valve seat 70 to allow fuel flow through the valve seat 70. The illustrated valve element 158 is substantially conically shaped, formed of a rubber, and captured on a barbed projection 162 of the float 154.

With continued reference to FIG. 9, the transport valve system 19 is assembled by inserting a gasket 166 into the threads 58 of the valve housing 34, and threading the fuel bowl 30 into sealed engagement with the valve housing 34. The valve closure assembly 150 is then inserted into the valve cavity 74. A diaphragm 170 and a gasket 172 are then placed on the housing flange 82 so that the valve closure assembly 150 is captured within the valve cavity 74.

The external seal 110 is slid onto the follower shaft 142 until it is adjacent the follower cap 138. Then the internal seal 118 is arranged in the seal recess 98 of the bonnet 38. The external spring 114 is then slid onto the follower shaft 142 and the follower shaft 142 is inserted through the actuator aperture 102 such that the internal seal 118 engages the follower shaft 142. The first button 122 is then engaged with the projection 146 of the cam follower 42.

Figure 10:
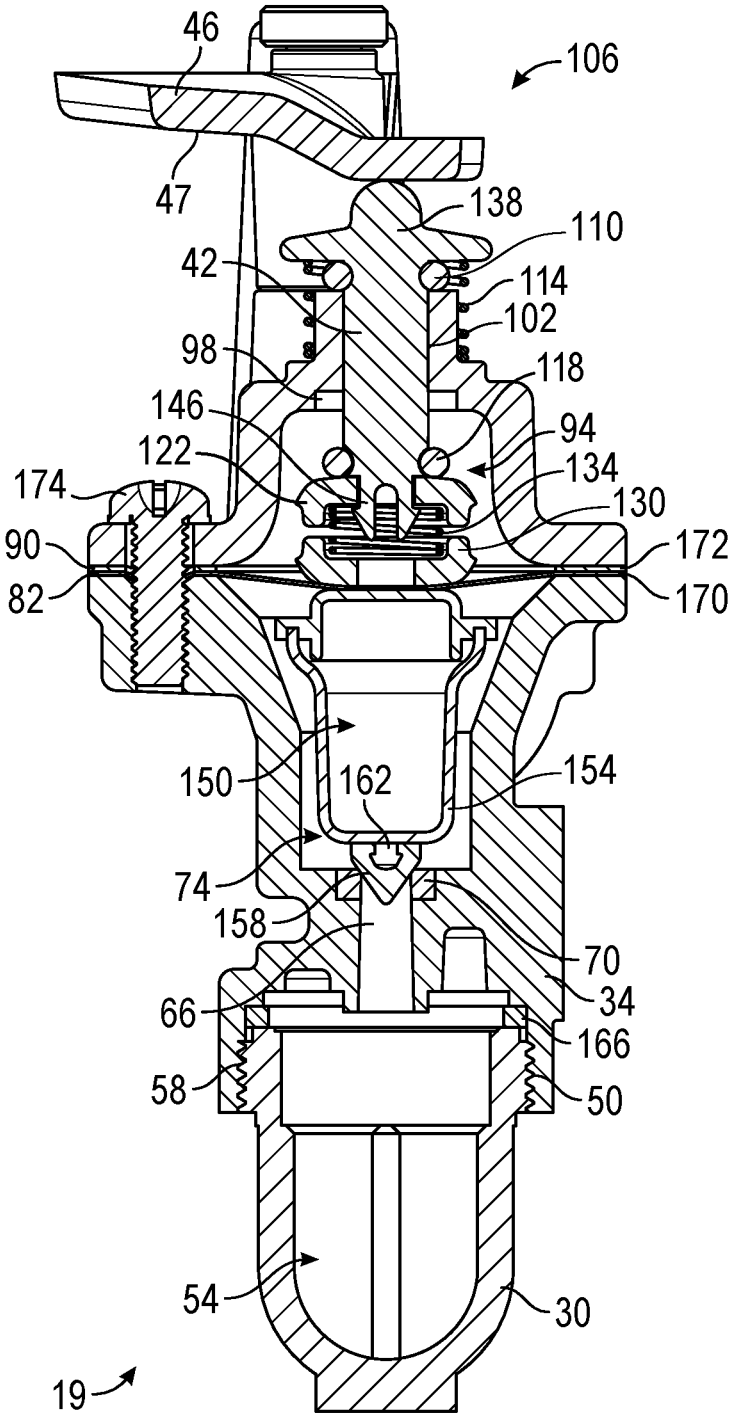
FIG. 10 is a section view of the transport guard valve in a closed position taken along line 10-10 of FIG. 3.

The bonnet 38 and cam follower 42, once assembled are arranged on top (as viewed in FIG. 9) of the diaphragm 170 and the gasket 172 with the bonnet flange 90 in contact with the gasket 172 and the housing flange 82 in contact with the diaphragm 170. Fasteners 174 are then engaged with the bonnet flange 90 and the housing flange 82 to compress the diaphragm 170 and the gasket 172 between the bonnet flange 90 and the housing flange 82 (see FIG. 10).

In operation, the engine 10 is operated by the user via manipulation of the speed control lever 17. Movement of the speed control lever 17 provides three distinct operations. First, the speed control lever 17 affects the governor system 18 which in turn affects the amount of fuel-air mixture passed from the carburetor 16 to the combustion cylinder of the engine 10 to control the operating speed of the engine 10. Second, actuation of the speed control lever 17 moves the cam 46 so that fuel flow through the transport valve system 19 to the carburetor 16 is selectively inhibited or allowed. Third, actuation of the speed control lever 17 moves the shutoff cam surface 22 so that the electrical shutoff switch 25 selectively inhibits or allows operation of the electrical system of the engine 10.

Figure 11:
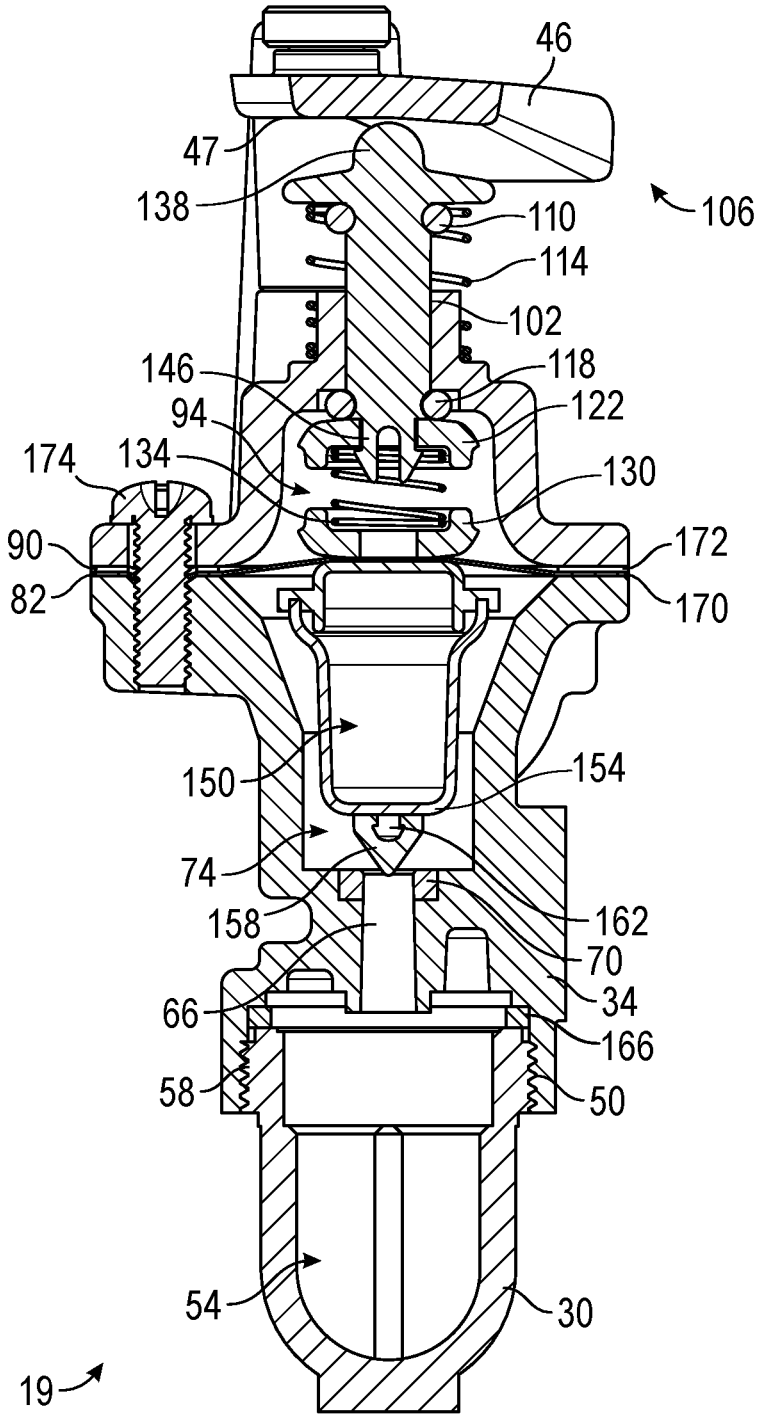
FIG. 11 is a section view of the transport guard valve in an open position taken along line 10-10 of FIG. 3.
Figure 12:
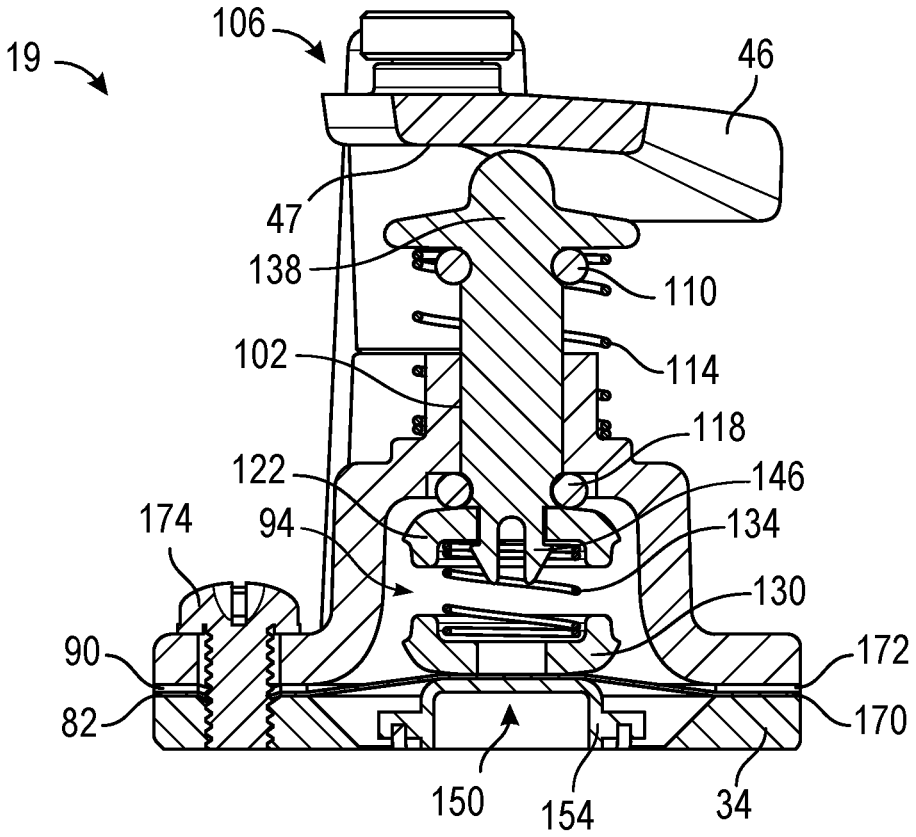
FIG. 12 is a detail view of a portion of the transport guard valve of FIG. 11.

When the speed control lever 17 is arranged in an on position (shown in FIG. 3), the engine 10 may be operated and run. As shown in FIG. 3, the shutoff cam surface 22 is arranged in an on-state so that the electrical shutoff switch 25 is arranged in the ungrounded position and allows operation of the electrical system. When the speed control lever is arranged in an on position, the cam 46 is arranged in the on-state (see FIG. 11) and the external spring 114 biases the cam follower 42 into an extended position such that the first button 122 and the second button 130 separate and allow the valve closure assembly 150 to be moved to an open position by deflecting the diaphragm 170. The deflection of the diaphragm 170 is also shown in FIG. 12. The internal spring 134 biases the second button 130 away from the first button 122 and tends to bias the valve closure assembly 150 toward a closed position where fuel flow is inhibited.

In order for fuel to flow past the valve seat 70, the floatation bias of the float 154 must overcome the bias of the internal spring 134 and the diaphragm 170. Reverse flow of fuel through the valve seat 70 is inhibited by gravity which causes the valve closure assembly 150 to fall downward toward the valve seat 70 when the engine 10 is in a normal operating position. Under normal circumstances, with the speed control lever 17 in the on position, the engine 10 is allowed to operate and run. The transport valve system 19 allows fuel flow. The speed control lever 17 can be manipulated within the on position in order to adjust the speed of the engine 10 without moving the cam 46 out of the on-state.

When the speed control lever 17 is arranged in the off position (see FIG. 2), the engine 10 is inhibited from operating or running. The shutoff cam surface 22 is arranged in an off-state so that the electrical shutoff switch 25 is actuated to a grounded position and inhibits operation of the electrical system. The cam follower 42 is urged by the cam profile 47 into a retracted position against the bias of the external spring 114 (see FIG. 10). The first button 122 is urged toward the valve closure assembly 150 so that the second button 130 presses against the diaphragm 170 and the valve closure assembly 150 is moved into a closed position where fuel flow is inhibited past the valve seat 70.

The above described transport valve system 19 allows users to shut off fuel flow to the carburetor 16 anytime the speed control lever 17 is arranged in an off position. This provides a number of advantages to the user. First, the user is not required to know that fuel flow during transportation of the engine 10 is not ideal. Often the user may forget to turn off a typical stop cock and the carburetor 16 may be allowed to flood with fuel while being transported, for example on a trailer. Second, the speed control system 15 integrates an electrical shutoff switch 25 so that anytime the user arranges the speed control lever 17 in the off position, the fuel is cut and the electrical system is also deactivated. This simplifies and improves the user's experience using the engine 10 while also improving the operation of the engine 10.

The transport valve system 19 and the speed control lever 17 are structured so that no more than six pounds of force are required to actuate the speed control lever 17 between the on position and the off position. In other embodiments, different force requirements may be met while staying within the bounds of the invention. The illustrated transport valve system 19 does not include an integrated choke feature, although one may be included.

Figure 13:
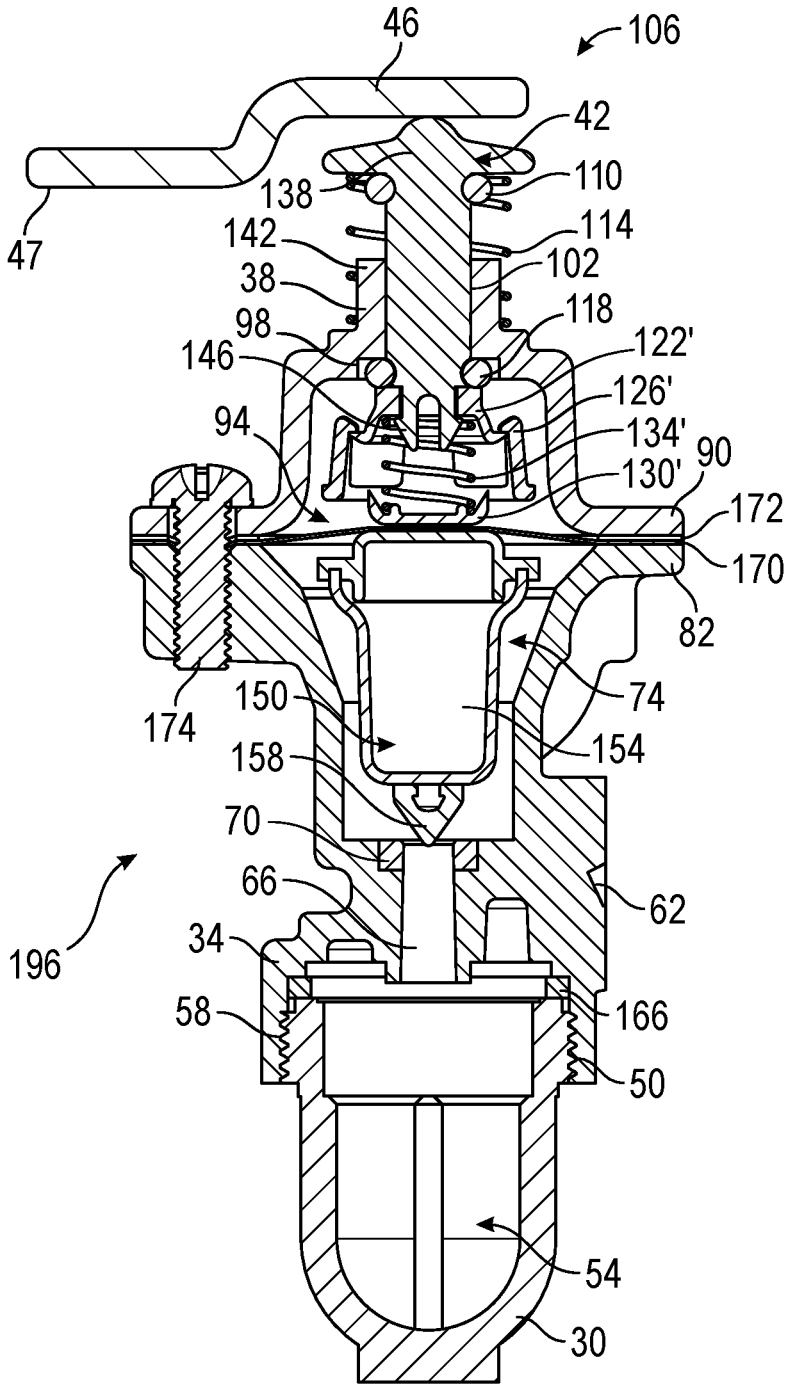
FIG. 13 is a section view showing another transport valve system according to one embodiment.

In another embodiment shown in FIG. 13, a valve 196 replaces the first button and the second button with a basket 122', a basket coupler 126', a button 130', and an internal spring 134'. The basket coupler 126' connects the basket 122' and the button 130' while allowing relative movement of the button 130' with respect to the basket 122'. The internal spring 134' is positioned between the basket 122' and the button 130' and biases the button 130' away from the basket 122'.

Figure 14:
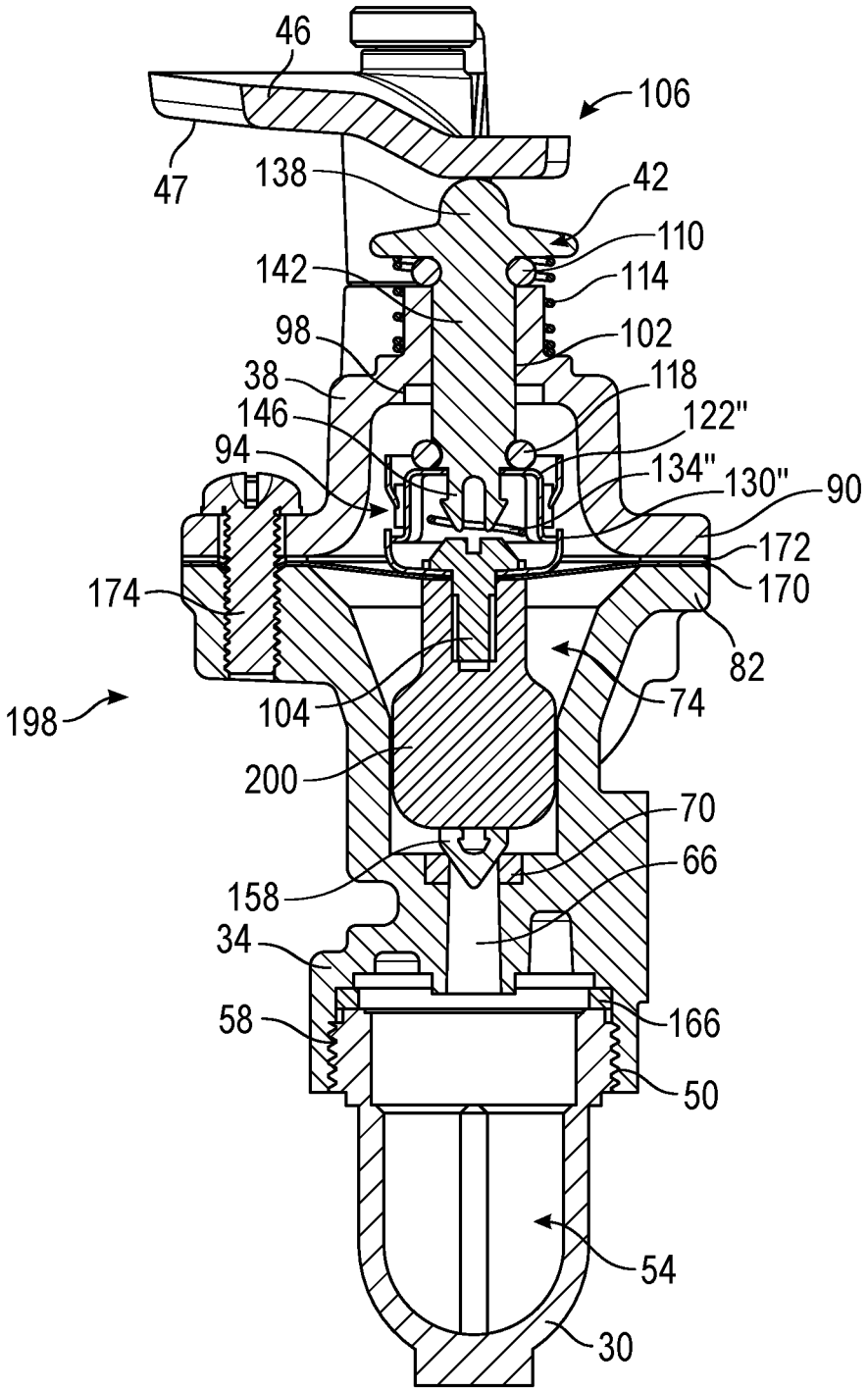
FIG. 14 is a section view showing another transport valve system according to one embodiment.

FIG. 14 illustrates another embodiment that is similar to the embodiment described above with respect to FIG. 13. As shown in FIG. 14, a valve 198 replaces the float 154 with a non-floating actuator 200 that is coupled to a button 130" by a fastener 204 that passes through a diaphragm 170. A basket 122" couples the button 130" to the projection 146. The fastener 204 rigidly connects the non-floating actuator 200 to the button 130". The illustrated non-floating actuator 200 is a solid, four fluted inlet needle and a valve element 158 is coupled to the non-floating actuator and structured to selectively allow and inhibit flow through the valve seat 70. The diaphragm 170 includes an aperture through which the fastener passes, and the aperture is sealed between the button 130" and the non-floating actuator 200 such that the bonnet cavity 94 is isolated from the valve cavity 74. The non-floating actuator 200 is actuated between open and closed positions as it follows the movement of the button 130" in response to the cam 46.

The construction and arrangements of the transport valve system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine comprising:

a fuel tank;

a carburetor including a throttle valve movable between a first throttle position and a second throttle position;

a governor system configured to move the throttle valve;

a speed control lever coupled to the governor system and movable between a first position corresponding to the first throttle position and a second position corresponding to the second throttle position; and a transport valve fluidly coupled between the fuel tank and the carburetor, the transport valve including;

a transport valve housing;

a diaphragm coupled to the transport valve housing and defining a valve cavity and a bonnet cavity isolated from the valve cavity by the diaphragm;

a valve seat positioned in the valve cavity;

a valve element positioned in the valve cavity for selective engagement with the valve seat;

an actuator coupled to the valve element and positioned in the valve cavity;

an actuation assembly positioned at least partially within the bonnet cavity and movable to an open valve position in response to movement of the speed control lever to the first position to allow fluid flow from the fuel tank, and movable to a closed valve position in response to movement of the speed control lever to the second position to stop fluid flow from the fuel tank;

a basket positioned within the bonnet cavity and coupled to the actuation assembly;

a button positioned within the bonnet cavity and coupled to the actuator with the diaphragm positioned therebetween; and a button spring coupled between the basket and the button to bias the button away from the basket.

2. The engine of claim 1, further comprising a cam coupled to the speed control lever and actuatable between an on-state and an off-state, wherein when the speed control lever is arranged in the second position, the cam is in the off-state.

3. The engine of claim 2, wherein the actuation assembly includes a cam follower arranged to urge the valve element toward the closed valve position when the cam is in the off-state, and a spring biasing the cam follower toward the cam.

4. The engine of claim 3, wherein the cam follower is positioned outside of the fuel flow.

5. The engine of claim 1, wherein the speed control lever controls engine speed by moving the throttle valve.

6. The engine of claim 1, further comprising an electrical shutoff switch arranged to inhibit electrical operation of the engine when the speed control lever is in the second position.

7. An engine shutoff system for an engine having a carburetor, the engine shutoff system comprising:

a speed control lever moveable to change an operating speed of the engine; and a valve moveable in response to movement of the speed control lever between an open position allowing fuel flow to the carburetor and a closed position inhibiting fuel flow to the carburetor including:

a diaphragm coupled defining a valve cavity and a bonnet cavity isolated from the valve cavity by the diaphragm;

a valve seat positioned in the valve cavity;

a valve element positioned in the valve cavity for selective engagement with the valve seat;

an actuator coupled to the valve element and positioned in the valve cavity;

an actuation assembly positioned at least partially within the bonnet cavity and movable between an open valve position to allow fuel flow, and a closed valve position to inhibit fuel flow in response to movement of the speed control lever;

a basket positioned within the bonnet cavity and coupled to the actuation assembly;

a button positioned within the bonnet cavity and coupled to the actuator with the diaphragm positioned therebetween; and a button spring coupled between the basket and the button to bias the button away from the basket.

8. The engine shutoff system of claim 7, further comprising:

a cam coupled to the speed control lever and actuatable between an on-state and an off-state in response to movement of the speed control lever, wherein the actuation assembly includes a cam follower arranged to urge the valve toward the closed position when the cam is in the off-state.

9. The engine shutoff system of claim 8, wherein the valve is isolated from the cam follower by the diaphragm.

10. The engine shutoff system of claim 7, further comprising an electrical shutoff switch arranged to inhibit electrical operation of the engine in response to the speed control lever being arranged in an off position.

11. A method of inhibiting fuel flow to a carburetor, the method comprising:

moving a speed control lever from an on position to an off position;

moving a valve closure element, including an actuator that is movable against a spring bias when fuel is present in the valve cavity, from a closed position where fuel flow is inhibited, to an open position where fuel flow is permitted; and moving the valve element closure element from the open position to the closed position in response to movement of the speed control lever to the off position.

12. The method of claim 11, further comprising:

moving a cam in response to the speed control lever from an on state to an off state; and moving a cam follower with the cam from a first position to a second position.

13. The method of claim 11, further comprising biasing the cam follower toward the first position with a spring.

14. The method of claim 11, further comprising isolating the cam follower from the valve closure element with a diaphragm.

15. The method of claim 11, further comprising actuating an electrical shutoff switch when the speed control lever is in the off position.

* * * * *